US005546686A

United States Patent [19]

You

[11] Patent Number: 5,546,686

[45] Date of Patent: Aug. 20, 1996

[54] ELECTROMOTIVE DEVICE FOR EXHIBITING PICTURES

[76] Inventor: Young Kwan You, 4/4, 23-1 Galwol-dong, Yongsan-ku, Seoul, Rep. of Korea

[21] Appl. No.: 343,463

[22] PCT Filed: Apr. 4, 1994

[86] PCT No.: PCT/KR94/00030

§ 371 Date: Nov. 28, 1994

§ 102(e) Date: Nov. 28, 1994

[87] PCT Pub. No.: WO94/23337

PCT Pub. Date: Oct. 13, 1994

[30] Foreign Application Priority Data

Apr. 6, 1993 [KR] Rep. of Korea ..... UM 1993-5346

[51] Int. Cl.[6] ..... G09F 11/00

[52] U.S. Cl. ..... 40/476; 40/466

[58] Field of Search ..... 40/463, 466, 473, 40/476, 511, 512

[56] References Cited

U.S. PATENT DOCUMENTS

| | | | |
|---|---|---|---|
| 1,179,490 | 4/1916 | Yaw | 40/476 |
| 1,555,057 | 9/1925 | Hinchey | 40/476 |
| 2,131,168 | 9/1938 | Eitzen | 40/476 |
| 3,813,797 | 6/1974 | Masters et al. | 40/476 |
| 3,972,522 | 8/1976 | Wallace . | |
| 5,309,654 | 5/1994 | Spencer | 40/473 |

FOREIGN PATENT DOCUMENTS

| | | | |
|---|---|---|---|
| 0035410 | 9/1981 | European Pat. Off. . | |
| 3014394 | 10/1981 | Germany . | |
| 267587 | 11/1990 | Japan | 40/512 |
| 2221555 | 2/1990 | United Kingdom . | |

*Primary Examiner*—Brian K. Green
*Attorney, Agent, or Firm*—Nixon & Vanderhye, P.C.

[57] ABSTRACT

An electromotive device for exhibiting pictures has an ascending carrier guided along rear guiding rails and a descending carrier guided along front guiding rails. The ascending carrier ascends and the descending carrier descends picture keeping members one by one. Upper compressing levers compress the picture keeping members at an upper position toward a front exhibition window when the ascending carrier is ascended, and lower compressing levers compress the picture keeping members at a lower position toward a rear exhibition window when the ascending carrier is descended. According to the electromotive device, a large quantity of exhibits such as photographs or pictures can be stored in good condition for a long time, and operational noise can be reduced. Further, the electromotive device provides ornamental value.

5 Claims, 7 Drawing Sheets

ELECTROMOTIVE DEVICE FOR EXHIBITING PICTURES

BACKGROUND OF THE INVENTION

1. Field of the Invention

The present invention relates to an electromotive device for exhibiting pictures, and more particularly to an electromotive device, by which a large quantity of exhibits such as photographs or pictures can be kept for a long time and the exhibits can be viewed easily and conveniently.

2. Discussion of the Prior Art

A photograph album is a conventional means for keeping exhibits such as photographs or pictures and viewing the exhibits on occasion. However, in the conventional photo album, manual work to turn over the leaves of the album is required to view the exhibits, and it is inconvenient for a plurality of persons to view the exhibits at the same time, and further it is not easy to view the exhibits because the album is usually kept in a remote place such as a bookself.

Meanwhile, two Korean Utility Model Applications of Serial Nos. 91-2357 and 91-21068 to overcome the above disadvantages were filed by the applicant of the present application.

The automatic circulation-type picture box of Korean Utility Model Application No. 91-2357 shown in FIG. 1 includes an ascending carrier 45, a descending carrier 49, compressing levers 47, 411a, 412, 412a, and descending control levers 48. In the photo box, the ascending carrier 45 ascends along guiding rails 44, 44a by means of the driving force of a motor 41 by carrying up a picture keeping member, and the descending carrier 49 descends by the gravitational force to carry down a picture keeping member.

Therefore, the picture keeping members can circulate in the box, and viewers can view the changing pictures through an exhibition window formed at the front surface of the box. However, when the descend carrier 49 carries the picture keeping member from the upper position to the lower position, because it falls by the gravitational force, noise is generated, and it may be unbalanced in the course of descending, so that its descending operation can not be smooth.

Further, support rings of the keeping members occupy a relatively large space, so that a large quantity of pictures can not be kept in the box, compared with the volume of the box.

Meanwhile, the automatic device for keeping and exhibiting exhibits of Korean Utility Model Application No. 91-21068 shown in FIG. 2 includes an ascending carrier 58' guided along guiding rails 51, 51', and a descending carrier 58 guided along guiding rails 52, 52'. In the device, a picture keeping member having no support ring is carried up to the upper position by the ascending carrier 58' and carried down to the lower position by the descending carrier 58, and the picture keeping members respectively at the upper position and at the lower position are compressed by serrulated supports 55, 55' and 56, 56' respectively. However, according to the above construction, a separate complex mechanism consisting of serrulated supports 55, 55', 56, 56', cams 512, 412', rods 57, 57', and a joint 514 is required to compress the picture keeping members, and a separation of the picture keeping members can not be prevented in case that an external impact is applied in the course of compressing the keeping members, because there are not included longitudinal guiding railing in the device. Further, there is a disadvantage that the exhibits can be viewed via only one surface of the device.

SUMMARY OF THE INVENTION

Accordingly, it is an object of the present invention to provide an electromotive device for exhibiting pictures, by which a large quantity of exhibits such as photographs or pictures can be kept: well for a long time and the exhibits kept can be viewed easily and conveniently.

It is another object of the present invention to provide an electromotive device for exhibiting pictures, in operation of which the generation of noise is reduced and the separation of picture keeping members is prevented, and by which the exhibits can be viewed via two opposite surfaces of the device.

It is another object of the present invention to provide an electromotive device for exhibiting pictures, by which the exhibits can be viewed by a plurality of persons at the same time and can be viewed easily and conveniently, and which presents ornamental value to the space in which the device is installed.

The present invention relates to an electromotive device for exhibiting pictures comprising an exhibit section, a support section for rotatively supporting the exhibit section and a control section for controlling the operations of the exhibit section and the support section. The exhibit section includes a housing having a front exhibition window formed at the upper part of the front surface thereof and a rear exhibition window formed at the lower part of the rear surface thereof, a plurality of picture keeping members circulating between the upper position and the lower position in the housing, upper suspending rails for suspending the picture keeping members at the upper position, lower suspending rails for suspending the picture keeping members at the lower position, an ascending carrier for ascending the picture keeping members one by one from the lower position to the upper position, a descending carrier for descending the picture keeping members one by one from the upper position to the lower position, driving means for providing the driving force to ascend and descend the ascending carrier and the descending carrier, rear guiding rails and front guiding rails for guiding the ascending and descending of the ascending carrier and the descending carrier, upper compressing levers to be operated by the picture keeping member which is being ascended by the ascending carrier, so as to compress the picture keeping members suspended at the upper position in the direction of the front exhibiting window, and lower compressing levers to be operated by the ascending carrier descending after carrying the picture keeping member, so as to compress the picture keeping members suspended at the lower position in the direction of the rear exhibiton window.

The picture keeping members respectively comprise an attachment plate on which exhibits are attached, and a suspension bar having engaging parts and suspension grooves formed at both ends thereof, and the ascending carrier and the descending carrier respectively include carrier pins at both ends thereof to be engaged with the engaging parts of the picture keeping member carried by the carriers.

The upper compressing levers are respectively disposed at upper rear parts of the both side surfaces of the housing and respectively include two legs in the shape of a tweezer, one of which can not contact with the ascending carrier but contacts with the picture keeping member put on the ascending carrier, and to the other of which bias rotating force in the inverse direction of the picture keeping members suspended by the upper suspending rails is applied by a spring connected thereto.

The lower compressing levers are respectively disposed near the lower suspending rails at the middle parts of both side surfaces of the housing so as to pivot about a pivot pin and respectively include two legs, one of which extends forward and upward so as to contact with the picture keeping members suspended by the lower suspending rails, the other of which extends rearward so as to contact with the ascending carrier, and to which bias rotating force in the direction of the picture keeping members suspended by the lower suspending rails is applied by a spring connected thereto.

BRIEF DESCRIPTION OF THE DRAWINGS

The above objects and other features of the present invention will become more apparent by describing the preferred embodiment thereof referring to the accompanying drawings, in which.

DETAILED DESCRIPTION OF PREFERRED EMBODIMENTS

Figure 1:
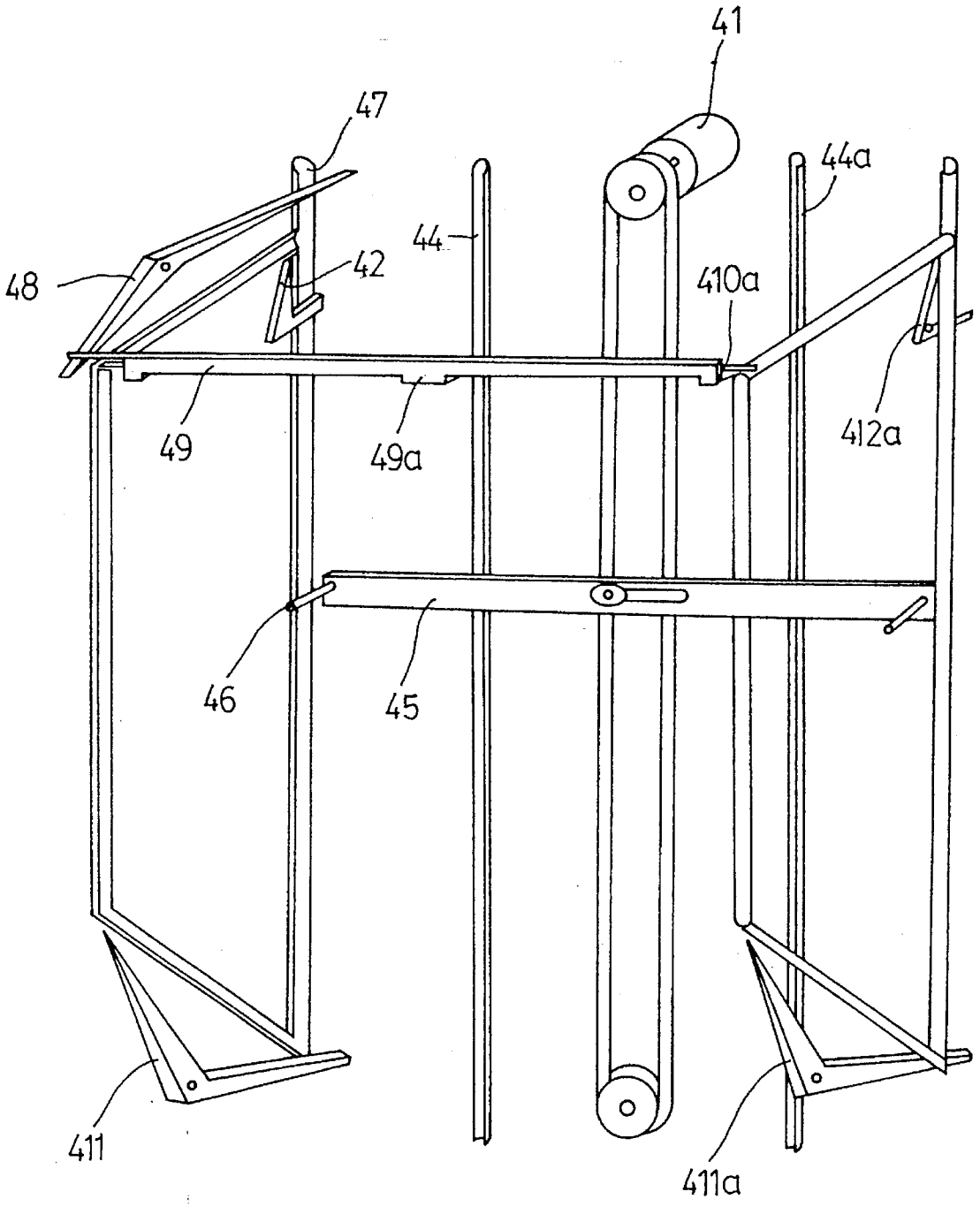
FIG. 1 PRIOR ART
FIG. 1 shows the inner construction of an automatic circulation-type picture box.
Figure 2:
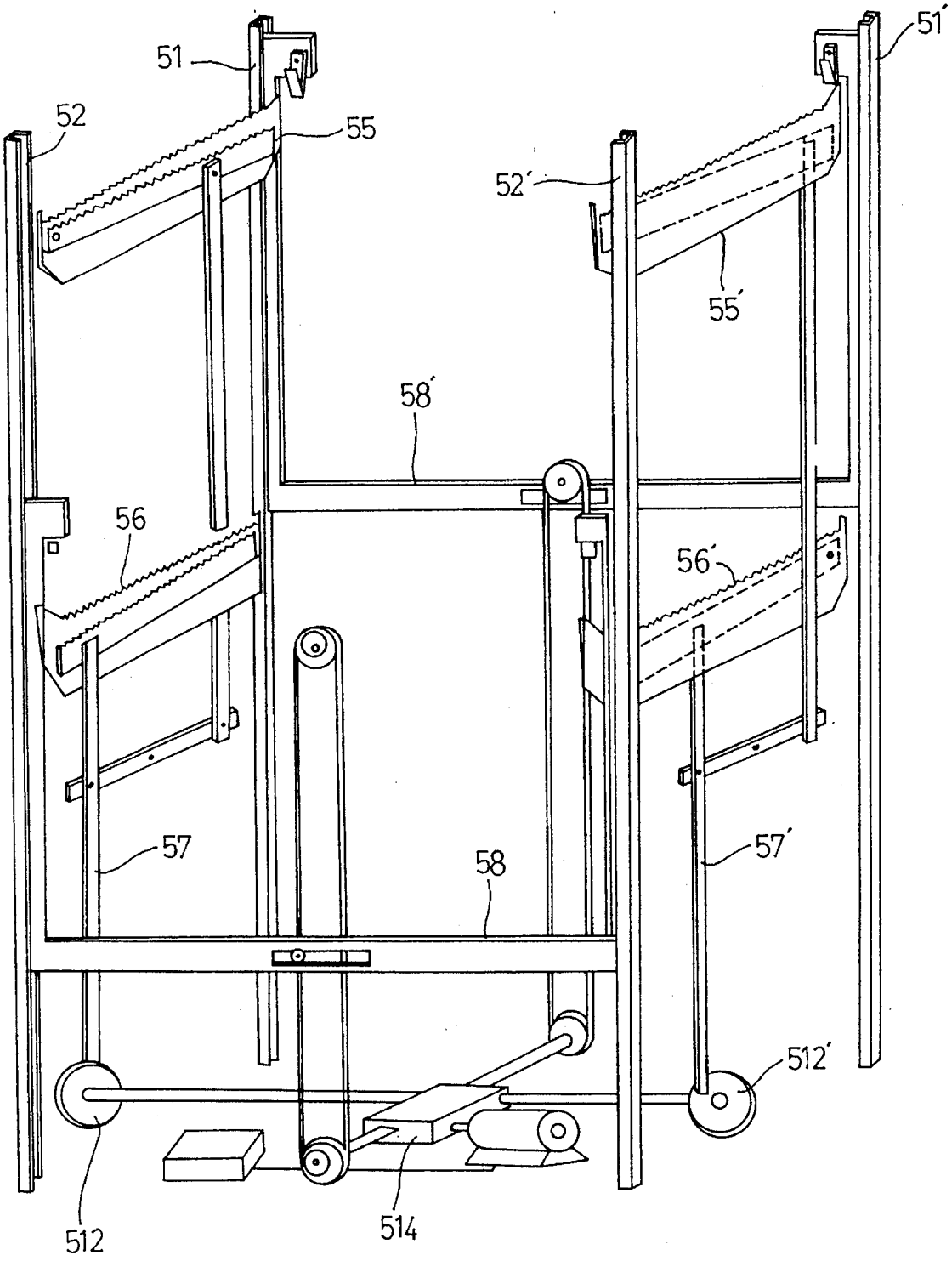
FIG. 2 PRIOR ART
FIG. 2 shows the inner construction of a conventional automatic device for keeping and exhibiting exhibits.
Figure 3A:
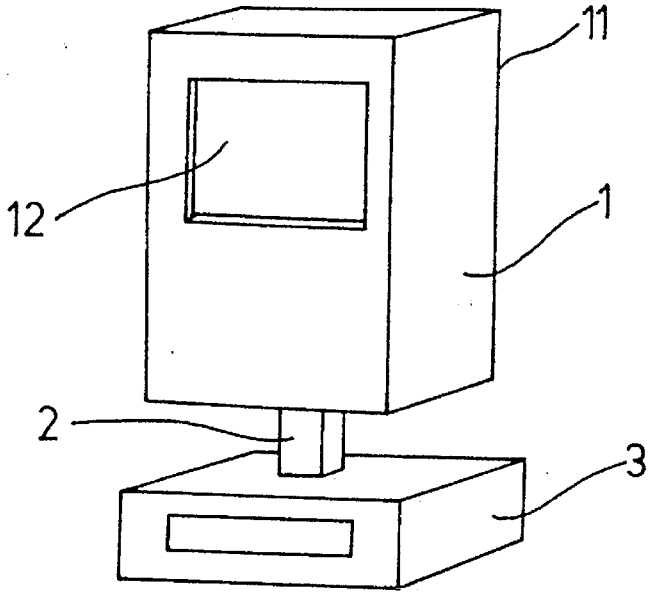
FIGS. 3A and 3B are respectively a front perspective view and a rear perspective view of an electromotive device for exhibiting pictures according to one embodiment of the present invention.
Figure 3B:
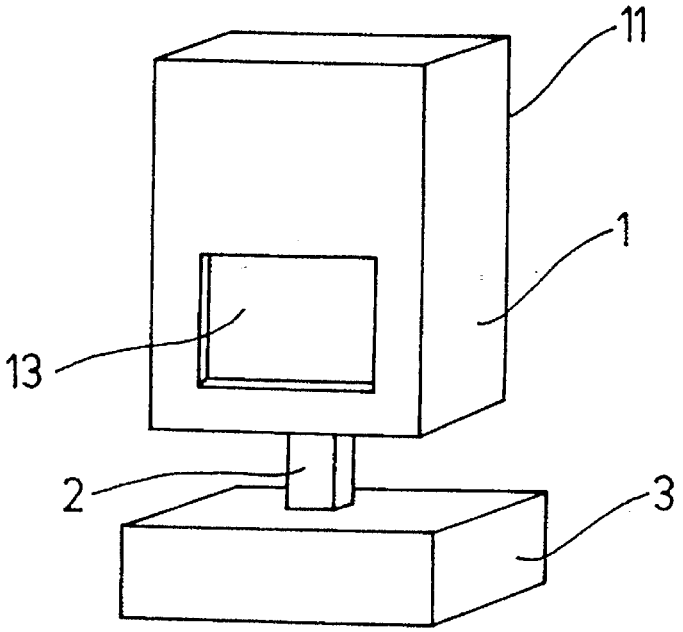

An electromotive device for exhibiting pictures according to an embodiment of the present invention comprises an exhibit section 1, a support section 2, and a control section 3, as shown in FIGS. 3A and 3B. The exhibit section 1 includes a housing 11 having a front exhibition window 12 formed at the upper part, of the front surface thereof and a rear exhibition window 13 formed at the lower part of the rear surface thereof.

Figure 6:
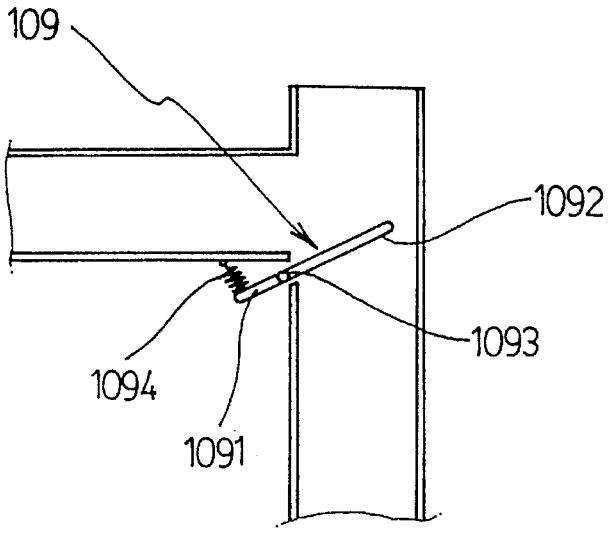
FIG. 6 is an enlarged view of a part designated by "a" in FIG. 4, FIGS. 7A and 7B are views to explain the disposition and the operation respectively of an upper compressing lever and a lower compressing lever of the electromotive device for exhibiting pictures shown in FIG. 4.

In the housing 11, two vertically extending front guiding rails 104 are respectively disposed at both side edges of the front surface, and two vertically extending rear guiding rails 103 are disposed at both side edges of the rear surface. At both side edges of the upper surface of the housing 11 are disposed two upper suspending rails 105, which are longitudinally extended slightly declining forward, and at the middle portions of both side surfaces of the housing 11 are disposed two lower suspending rails 106, which are longitudinally extended declining rearward. Snap members 109 are respectively disposed at both corners between the rear guiding rails 103 and the upper suspending rails 105. Referring to FIG. 6 showing the detailed construction of the snap member 109, a middle point of the snap member 109 is hingedly connected to the housing by a pivot pin 1093 so that the snap member 109 can pivot about the pivot pin 1093, and an end 1091 of the snap member 109 is connected to a spring 1094 supported by the upper suspending rails 105, the other end 1092 of the snap member 109 extends slightly inclining into the rear guiding rail 103.

Referring again to FIG. 4, carriers 101, 102 are included in the housing 11, the ascending carrier 101 being engaged in the rear guiding rails 103, and the descending carrier 102 being engaged in the front guiding rails 104. The ascending carrier 101 and the descending carrier 102 respectively including carrier pins 111, 112 respectively alternate up-and-down along the rails 103, 104 by driving means. In the present embodiment, the driving means consists of driving motors 131,132, driving pulleys 141, 142 connected to the respective driving motors 131, 132, following pulleys 1411, 1421, and belts 121,122 put on the driving pulleys 141, 142 and following pulleys 1411, 1421 and respectively jointed with the ascending carrier 101 and the descending carrier 102, while in other embodiments, the carriers 101, 102 may alternate up-and-down by one driving motor, or other proper modification of the driving means can be adopted.

Upper compressing levers 107 in the shape of tweezers are disposed at upper rear parts of the both side surfaces of the housing, and lower compressing levers 108 are disposed near the lower suspending rails at the middle parts of both side surfaces of the housing.

The upper compressing levers 107 are disposed out of the range of the length of the ascending carrier 101, so that the empty ascending carrier 101 does not contact with the upper compressing lever 107 when it descends after carrying a picture keeping member, while the lower compressing levers 108 are disposed in the range of the length of the ascending carrier 101, so that the empty ascending carrier 101 can contact with one leg 1082 of the lower compressing lever 108 when it reaches its lower position. The middle parts of the respective levers 107, 108 are hingedly attached to the housing by pivot pins so that the levers 107, 108 can pivot about the respective pivot pins. Furthermore, as shown in FIG. 7, springs 1073, 1083 are connected to the levers 107, 108 and are supported by struts 1074, 1084, thereby bias forces can be applied to the levers 107, 108.

Figure 8:
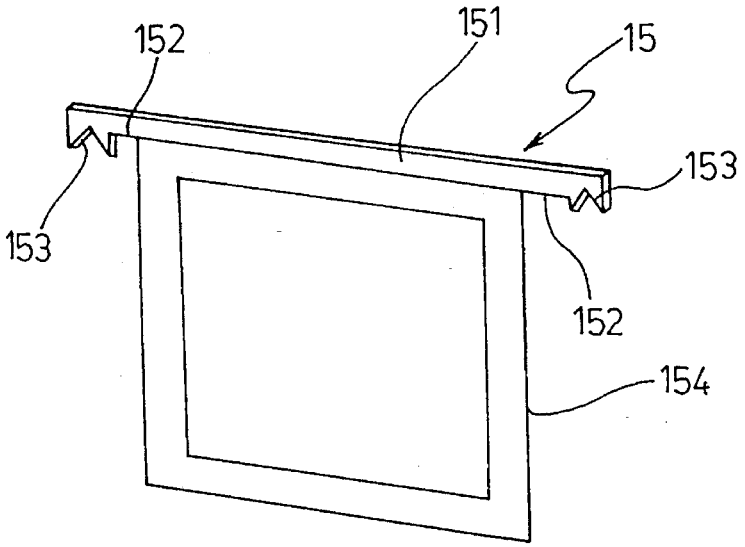
FIG. 8 is a perspective view of a picture keeping member according to one embodiment of the present invention.

Meanwhile, a picture keeping member, which is carried by the carriers 101, 102 to circulate in the housing, comprises an attachment plate 154 on which exhibits are attached, and a suspension bar 151 having engaging parts 152 and suspension grooves 153 formed at both ends thereof, as shown in FIG. 8.

Figure 4:
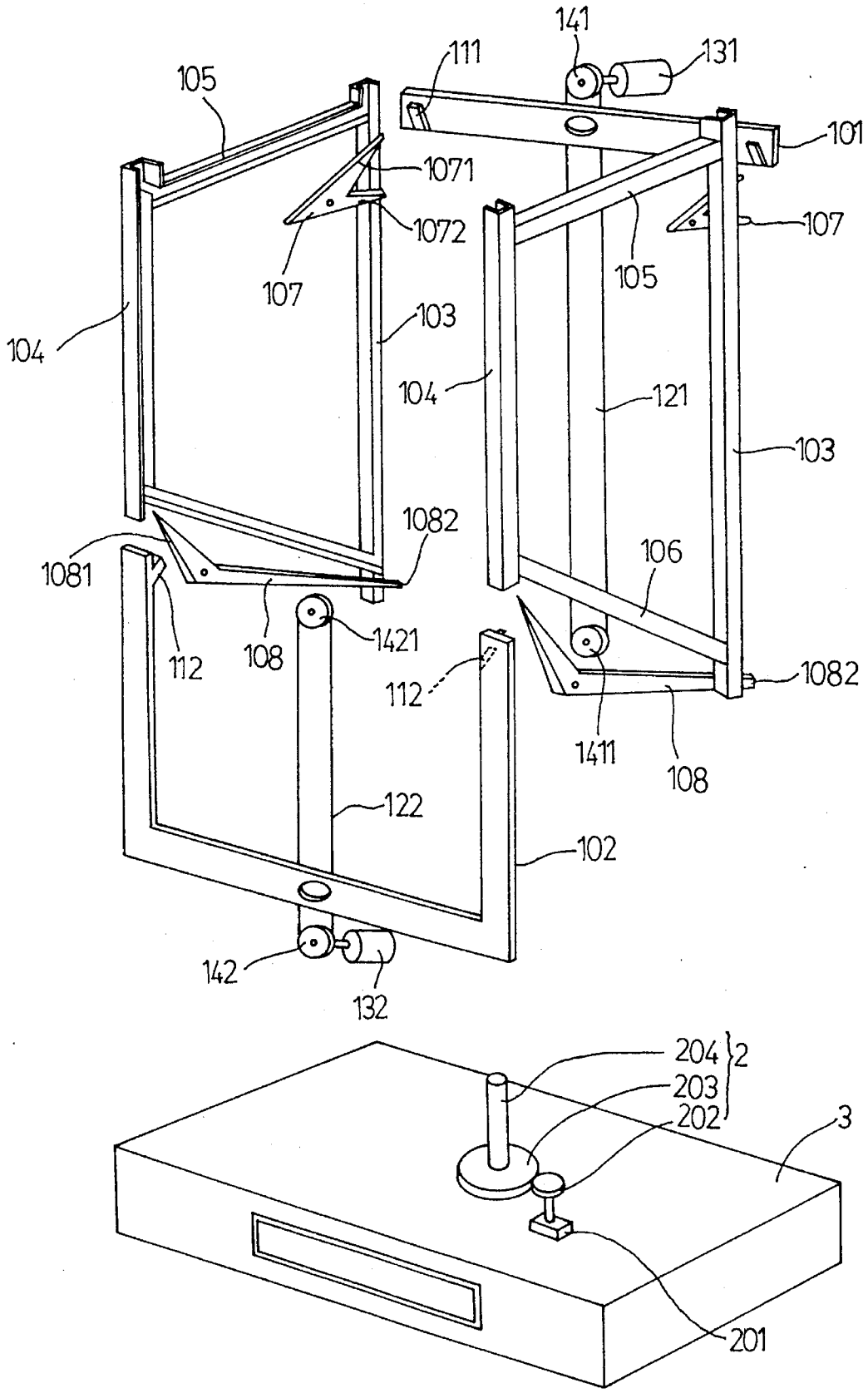
FIG. 4 shows the inner construction of an electromotive device for exhibiting pictures according to one embodiment of the present invention.

The support section 2 comprises a rotating shaft 204 for rotatively supporting the exhibit section 1, a following gear 203 incorporated with the rotating shaft 204, a driving gear 202 engaged with the following gear 203, and a rotating motor 201 connected to the driving gear 202, as shown in FIG. 4. However, in the other embodiments, a construction that a rotating motor is directly connected to a rotating shaft for rotatively supporting the exhibit section 1 can be adopted.

Figure 9:
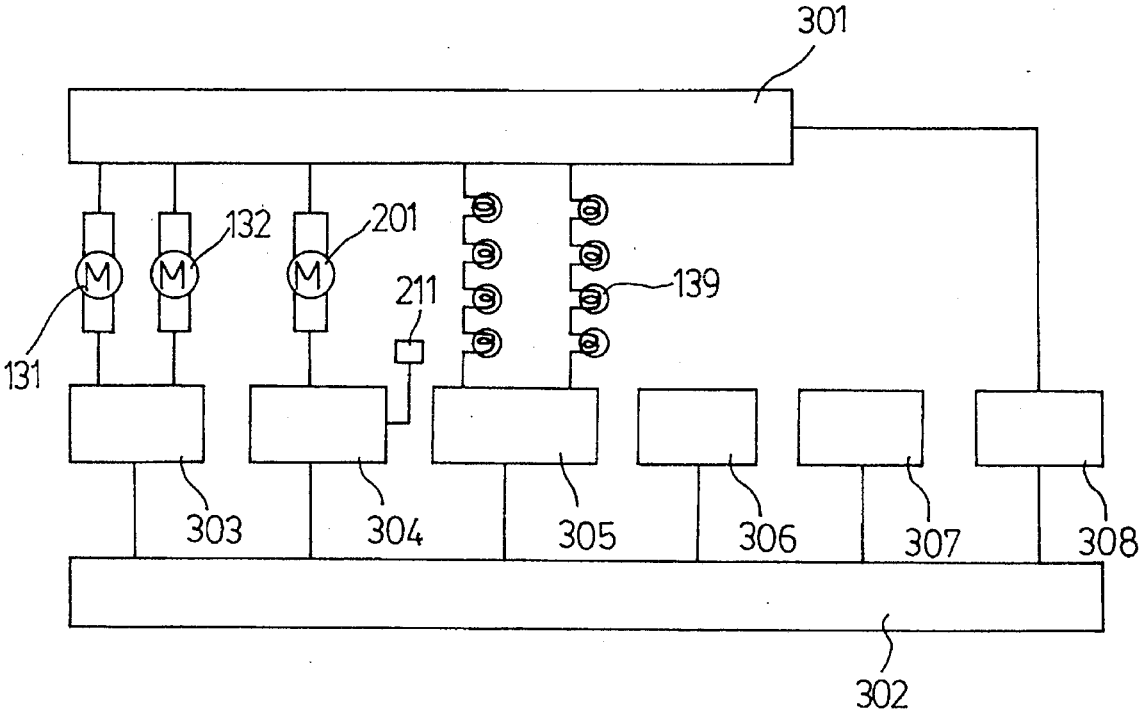
FIG. 9 shows the construction of circuits included in the control section of an electromotive device for exhibiting pictures according to one embodiment of the present invention.

FIG. 9 shows a construction of the control section 3 according to an embodiment of the present invention, which includes a power supplying circuit 301, a control signal receiving circuit 302, a carrier driving circuit 303, a rotation control circuit 304, a light control circuit 305, a timer circuit 306, a melody circuit, and a power switch 308.

Figure 5:
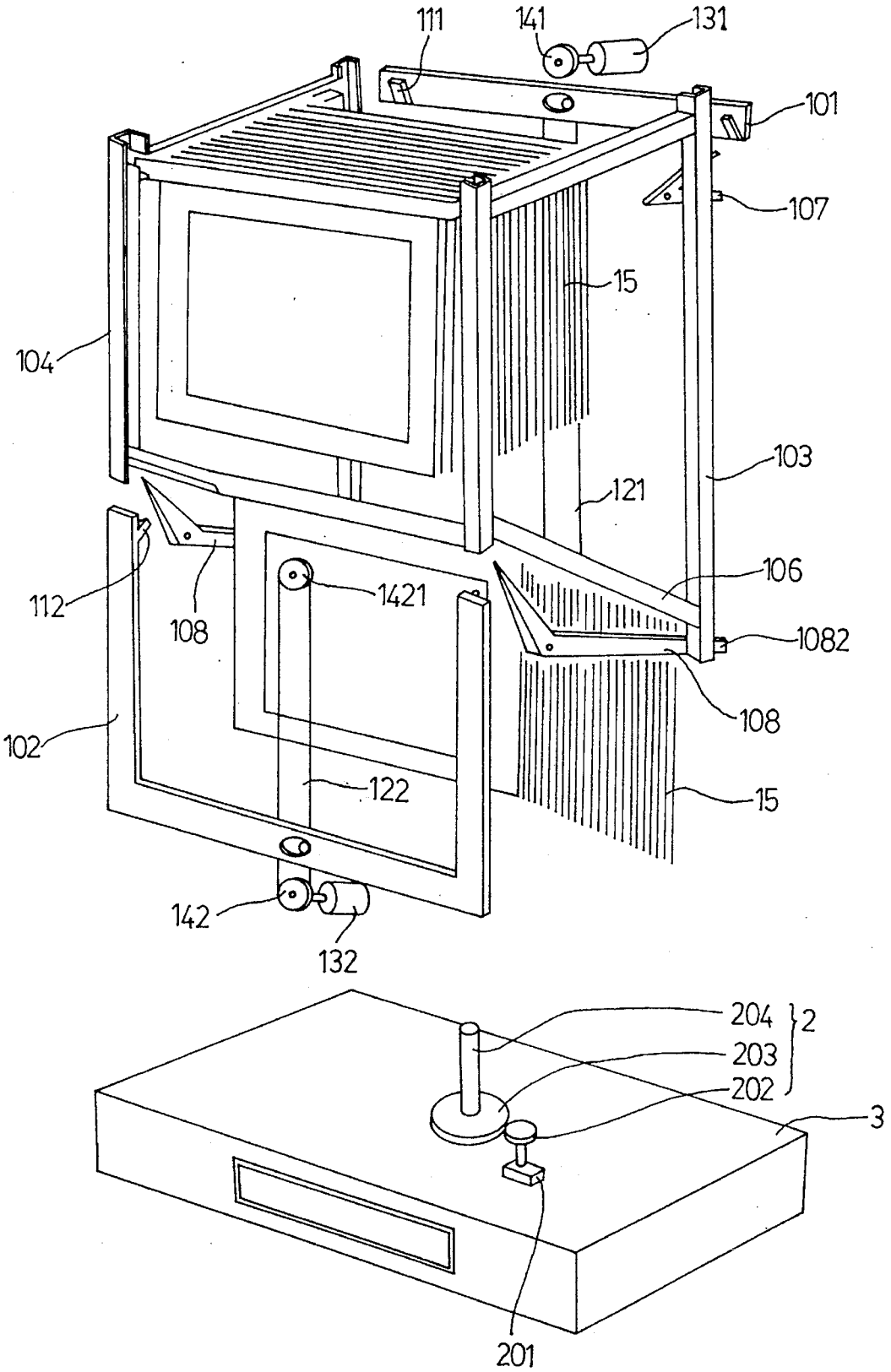
FIG. 5 is a view to explain the circulation of picture keeping members in the device shown in FIG. 4.

The operation of an electromotive device for exhibiting pictures according to an embodiment of the present invention having the above-described construction will be described hereinafter, referring to FIG. 5.

If a user applies a driving signal to the control section 3 by means of a remote controller, power is supplied to the driving motors 131, 132 through the carrier driving circuit 303 of the control section 3, thereby the carriers 101, 102 can ascend or descend by the driving motors 131, 132.

The picture keeping members 15 circulate in the housing 11 through the following process. That is, the engaging parts 152 of the picture keeping member 15 at the rearmost of the lower position are engaged in the carrier pins 111 of the carrier 101, and then the ascending carrier 101 with the picture keeping member 15 ascends accordingly the pulleys 141, 1411 are rotated by the driving motor 131.

Figure 7A:
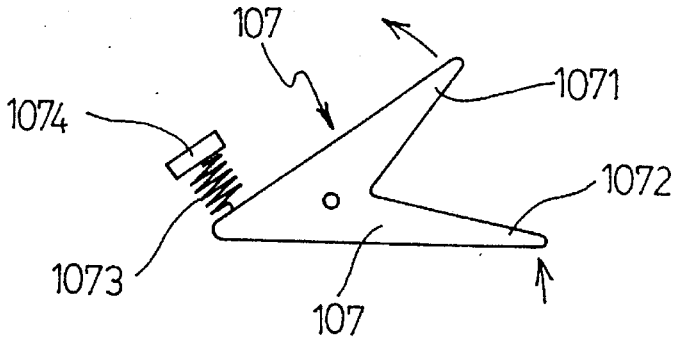
Figure 7B:
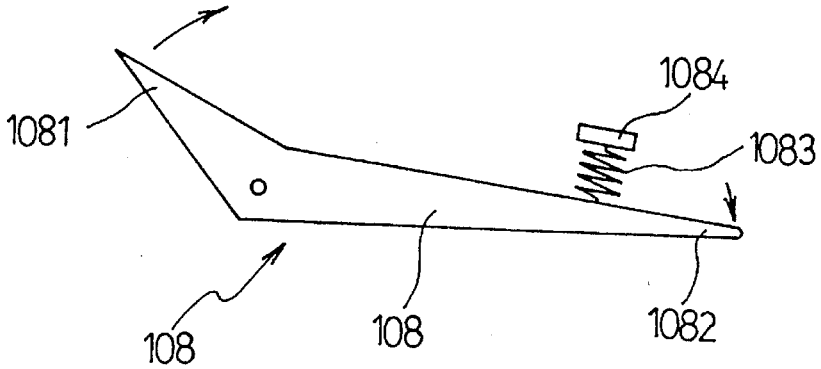

Meanwhile, the suspension bar 151 of the picture keeping member 15 is longer than the carrier 101 so as to contact with the legs 1072 of one side of the upper compressing levers 107 in the course of ascending, thereby it can rotate the upper compressing levers 107 in the direction of the arrow in FIG. 7A by the above-mentioned contact. If the suspension bar 151 rotates the upper compressing levers 107, the legs 1071 of the other side of the upper compressing levers 107 compress the picture keeping members 15 suspended by the upper suspension rails in a forward direction.

After the carrier 101 with the picture keeping member 15 pass away, the upper compressing levers 107 are returned to their initial position by springs 1073. Meanwhile, the picture keeping member 15 on the carrier 101 continues to ascend to pass through the snap member 109. At this time, the suspension bar 151 of the picture keeping member 15 is put on the snap member 109 instantly by the snap action of the snap member 109 due to the spring force of the spring 1094, and then it slides down the declined snap member 109 to be put on the upper suspending rails 105, while the ascending carrier 101 descends after being emptied Meanwhile, the picture keeping members 15 suspended in the upper position by the upper suspending rails 105 descend one by one by the descending carrier 102. That is, the engaging parts 152 of the suspension bar 151 of the picture keeping member 15 at the frontmost of the upper position are engaged in the carrier pins 112 of the descending carrier 102, and then the descending carrier 102 with the picture keeping member 15 descends by the driving motor 132.

When the carriers 102 reaches near its lowest position, the suspension grooves 153 of the suspension bar 151 of the picture keeping member 15 meet the lower suspending rail, and then the carrier 102 continues to descend to be disengaged with the picture keeping member 15, while the picture keeping member 15 moves rearward along the declined lower suspending rails 106. The descending carrier 102 after descending the picture keeping member can ascend again after being emptied, so as to descend the next picture keeping member. Meanwhile, after the descending carrier 102 descends the picture keeping member 15, the ascending carrier 101 descends to its lowest position to press the legs 1082 of the lower compressing lever 108, so that the compressing levers 108 rotate in a direction of the arrows in FIG. 7B, and thereby the legs 1081 of the compressing levers 108 compress the picture keeping members 15 suspended by the lower suspending rails 106 rearward.

The operation according to the process described above can be reiterated by operating the remote controller in every case that the exhibited picture needs to be changed. Otherwise, by including a time-delay circuit in the carrier driving circuit of the control section 3 shown in FIG. 9, it is possible to make the operations of the above process perform at every predetermined time interval such as three to four seconds or an hour corresponding to the required time to view the exhibits.

Further, it is preferred that the lower compressing levers 108 are operated by the ascending carrier 101 after the descending carrier 102 descends a picture keeping member 15, and to ensure this, the carrier driving circuit 303 controls the driving of the motors 131,132 so that the operations of the ascending carrier 101 and the descending carrier 102 can be harmonized. If needed, sensors for sensing the positions of the carriers 101, 102 can be disposed at proper points of the guiding rails 103, 104 to more certainly ensure the above-mentioned control.

Illuminating lamps to help the exhibits to be viewed well, as shown in FIG. 9 can be disposed at proper positions in the housing, and switching and lightness of the lamps 139 can be controlled by the light control circuit 305 included in the control section 3 shown in FIG. 9.

The exhibits attached to the attachment plate 154 of the picture keeping member 15 at the upper position can be viewed through the front exhibition window 12 of the housing 11, while the exhibits attached to the attachment plate 154 of the member 15 at the lower position can be viewed through the rear exhibition window 13.

However, if needed, it is also possible to view the exhibits through the front window 12 and the rear window 13 without changing the viewer's position by rotating the exhibit section 1 by means of the rotation control circuit of the control section 3 shown in FIG. 9. That is, if a viewer drives the rotation control circuit 304 with a remote controller, the rotation control circuit 304 drives the rotating motor 201, which rotates the driving gear 202. And then, the following gear 203 engaged with the driving gear 202 rotates, thereby the rotating shaft incorporated with the following gear 203 and the exhibit section 1 connected thereto rotate.

Furthermore, by making the melody circuit 307 of the control section 3 shown in FIG. 9 operated in rotation of the exhibit section 1, in the ascent and descent of the carriers, or in the viewer's viewing, the rotation of the exhibit section or change of the exhibits can be informed by music, or viewing with music can be possible. A timer circuit 306, which is included in the control section 3 as shown in FIG. 9, can switch the power switch 308.

According to the electromotive device for exhibiting pictures of the present invention as described above, a large quantity of exhibits such as photographs or pictures can be kept well for a long time and the exhibits kept can be viewed easily and conveniently. And the generation of noise is reduced and the separation of the picture keeping members is prevented in operation of the device.

Further, the exhibits can be viewed via two opposite surfaces of the device by the viewers at two opposite positions, and viewing the exhibits without changing the viewer's position by rotating the exhibit section 1, thereby viewing the exhibits by a large number of persons at the same time is possible. Furthermore, the device presents ornamental value to the space in which the device is installed.

What is claimed is:

1. An electromotive device for exhibiting pictures comprising:

an exhibit section including:

a housing having a front exhibition window formed at an upper part of a front surface of the housing and a rear exhibition window formed at a lower part of a rear surface of the housing, a plurality of picture keeping members circulating between an upper position and a lower position in the housing, two upper suspending rails for suspending the picture keeping members at the upper position, the upper suspending rails declining forward and extending longitudinally along both inner side edges of an upper surface of the housing, two lower suspending rails for suspending the picture keeping members at the lower position, the lower suspending rails declining backward and extending longitudinally along middle portions of both side surfaces of the housing, rear guiding rails vertically extending along both inner side edges of the rear surface of the housing, from guiding rails vertically extending along both inner side edges of the front surface of the housing, an ascending carrier, guided along the rear guiding rails, for ascending the picture keeping members one by one from the lower position to the upper position, a descending carrier, guided along the front guiding rails, for descending the picture keeping members one by one from the upper position to the lower position, driving means for providing a driving force to ascend and descend the ascending carrier and the descending carrier, upper compressing means, lower compressing means, and snap members disposed at both corners between the rear guiding rails and the upper suspending rails, each of the picture keeping members operating the upper compressing means to compress the picture keeping members suspended at the upper position toward the front exhibition window when said each of the picture keeping members is ascended by the ascending carrier, the ascending carrier operating the lower compressing means to compress the picture keeping members suspended at the lower position toward the rear exhibition window when the ascending carrier is descended, said each of the picture keeping members including:

an attachment plate for holding exhibits and a suspension bar assembled integrally with the attachment plate, the suspension bar having engaging parts and suspension grooves formed at both ends of the suspension bar, the ascending carrier and the descending carrier respectively including carrier pins at both ends of the ascending carrier and the descending carrier, the carrier pins being engaged with the engaging parts of said each of the picture keeping members, each of the snap members being pivotally supported by a pivot pin hingedly connected to a middle point of said each of the snap members, said each of the snap members having a first end connected to a first spring, the first spring being fixed to each of the upper suspending rails, and a second end extending backward and upward into each of the rear guiding rails, so that each of the picture keeping members is put on the upper suspending rails from the ascending carrier when said each of the picture keeping members passes the snap members;

means for rotatively supporting the exhibit section; and means for controlling operations of the exhibit section and the support means.

2. The electromotive device for exhibiting pictures as claimed in claim 1, wherein the upper compressing means comprises two upper compressing levers pivotally fixed to upper rear parts of both side surfaces of the housing, each of the upper compressing levers including a first and a second legs in shape of a tweezer, said each of the upper compressing levers being connected to a second spring for applying a restoring force to said each of the upper compressing levers, said each of the picture keeping members pushing the first leg and thereby rotating the upper compressing levers so that the second leg compresses the picture keeping members suspended at the upper position toward the front exhibition window when said each of the picture keeping members is ascended by the ascending carrier, and the lower compressing means comprises two lower compressing levers pivotally fixed to middle parts of both side surfaces of the housing, each of the lower compressing levers having a third and a fourth legs, the third leg extending forward and upward so as to contact the picture keeping members suspended at the lower position, the fourth leg extending backward, so that the third leg compresses the picture keeping members suspended at the lower position toward the rear exhibition window when the ascending carrier is descended.

3. The electromotive device for exhibiting pictures as claimed in claim 2 further comprising sensors for sensing positions of the ascending carrier and the descending carrier, the sensors being disposed at the front guiding rails and the rear guiding rails.

4. The electromotive device for exhibiting pictures as claimed in claim 1, wherein the support means comprise a rotating shaft for rotatively supporting the exhibit section, a following gear incorporated with the rotating shaft, a driving gear engaged With the following gear, and a rotating motor for driving the driving gear.

5. The electromotive device for exhibiting pictures as claimed in claim 1, wherein the controlling means comprises:

a power supply circuit for supplying a power to the electromotive device;

a control signal receiving circuit for receiving signals from a remote controller operated by an operator;

a carrier driving circuit for driving the ascending carrier and the descending carrier so as to exhibit and change the pictures in the exhibit section;

a rotation control circuit for controlling a rotation of the exhibit section;

a light control circuit for lighting the exhibit section;

a timer circuit for automatically switching the power;

a melody circuit for providing music in exhibiting pictures; and a power switch.

* * * * *